US006700116B2

(12) United States Patent
Taniguchi

(10) Patent No.: US 6,700,116 B2
(45) Date of Patent: Mar. 2, 2004

(54) ION TRAP MASS SPECTROMETER

(75) Inventor: Junichi Taniguchi, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 74 days.

(21) Appl. No.: 09/987,113

(22) Filed: Nov. 13, 2001

(65) Prior Publication Data

US 2002/0074492 A1 Jun. 20, 2002

(30) Foreign Application Priority Data

Dec. 14, 2000 (JP) ..... 2000-379683

(51) Int. Cl.[7] ..... H01J 49/42
(52) U.S. Cl. ..... 250/282; 250/292; 250/290
(58) Field of Search ..... 250/282, 290, 250/292

(56) References Cited

U.S. PATENT DOCUMENTS 5,179,278 A * 1/1993 Douglas ..... 250/290
5,750,993 A * 5/1998 Bier ..... 250/282
5,783,824 A * 7/1998 Baba et al. ..... 250/281
6,107,628 A * 8/2000 Smith et al. ..... 250/292

* cited by examiner

*Primary Examiner*—John R. Lee
*Assistant Examiner*—Paul M. Gurzo
(74) *Attorney, Agent, or Firm*—Kanesaka & Takeuchi

(57) ABSTRACT

In an ion trap mass spectrometer, between an ion supply source and an ion trap, there are disposed an entrance gate electrode, an ion storing section for holding ions by accumulating them near an exit side by means of an RF voltage with an axial electric potential inclined from an entrance side to the exit side, and an exit gate electrode. When the ions are accumulated near the exit side, the exit gate electrode is opened to thereby introduce the ions in the pulse state into the ion trap. At this point, a voltage is not applied to a ring electrode of the ion trap, so that repulsion due to the voltage of the ring electrode is eliminated. Thereafter, when maximum amount of ions stay inside the ion trap, ring RF voltage is suddenly applied. Thus, the maximum amount of the ions can be introduced into the ion trap.

9 Claims, 5 Drawing Sheets entrance side exit side

Fig. 5(a)
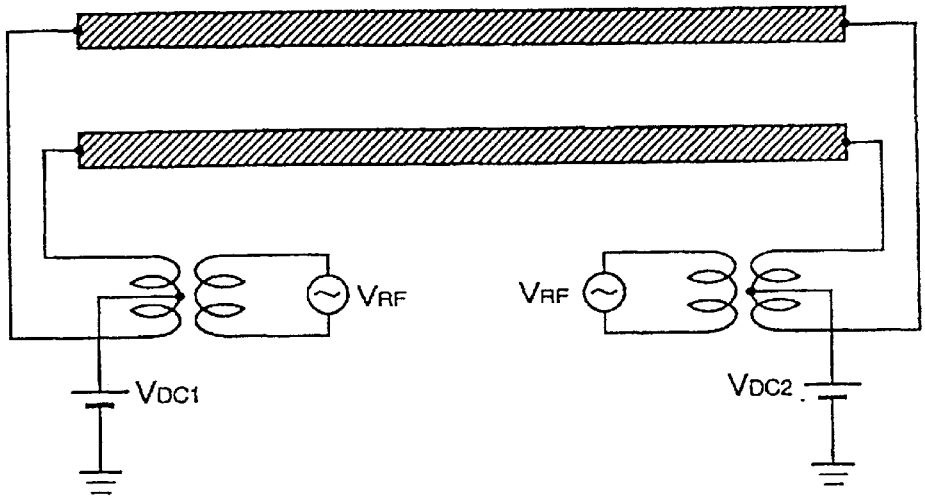
Fig. 5(b)
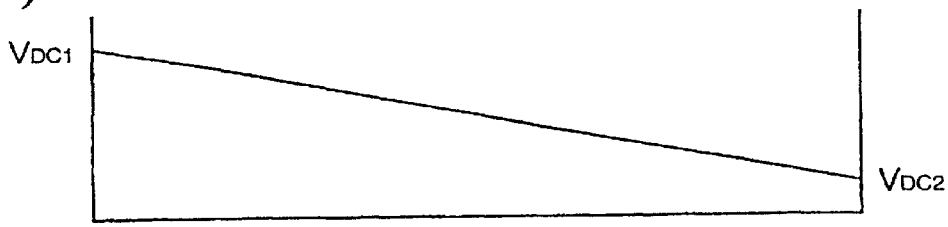
Fig. 6(a)
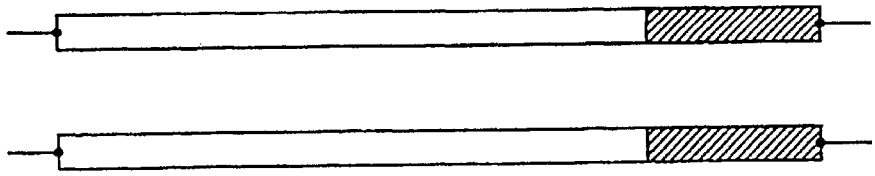
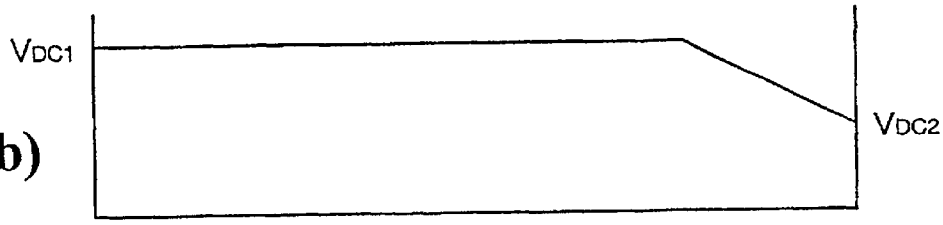
Fig. 6(b)

ION TRAP MASS SPECTROMETER

BACKGROUND OF THE INVENTION AND RELATED ART STATEMENT

The present invention relates to an ion trap mass spectrometer which can be used for liquid chromatograph mass spectrometry (LCMS) and gas chromatograph mass spectrometry (GCMS).

FIG. 1 shows a liquid chromatograph mass spectrometer (LCMS) using a conventional ion trap mass spectrometer. Respective components temporally separated by a liquid chromatograph (LC) 11 are ionized at an ionization section 12, and continuously introduced to an ion trap mass spectrometer 13.

The ion trap mass spectrometer 13 includes one annular ring electrode 14 having an inner surface in one revolution form of hyperboloid, and a pair of end cap electrodes 15 and 16, which have inner surfaces in two revolution forms of hyperboloid and are disposed to face each other with the ring electrode 14 therebetween. By applying radio-frequency (RF) alternating voltage between the ring electrode 14 and the end cap electrodes 15 and 16, a quadrupole electric field is formed in a space surrounded by the electrodes 14, 15 and 16 (hereinafter referred to as "an ion trap space").

Ions introduced from a through hole in one end cap electrode 15 are once captured by the quadrupole electric field in the ion trap space. In this condition, an alternating voltage (auxiliary alternating voltage) having a specific frequency is applied between the end cap electrodes 15 and 16, so that only ions having a specific mass number (mass/charge) corresponding to the specific frequency are resonated and oscillated inside the electric field in the ion trap space, to thereby exclude the ions from the ion trap space. If the voltage applied to the end cap electrodes 15 and 16 is adequately set and a collision gas is introduced into the ion trap space, the ions having the specific mass number can be excited and dissociated.

This method is used for an MS/MS analysis. The ion trap device structured as described above may be used by itself as the mass spectrometer, or a measurement with high mass resolution may be conducted by introducing the ions ejected from the ion trap space into another mass spectrometer (for example, time-of-flight mass spectrometer, that is, TOF).

In case the ions are introduced into the ion trap mass spectrometer 13, an amount of introduced ions is greatly effected by the RF voltage applied to the ring electrode 14 of the ion trap mass spectrometer 13. For example, in case the phase of the RF voltage is a positive potential, positive ions which reach the ion trap mass spectrometer 13 are bounced back therefrom, so that the positive ions can not enter into the ion trap space. Also, in case the phase is a negative potential, the positive ions are excessively accelerated, and collide with the end cap electrode 16 in the exit side to disappear. In the limited intermediate phase between the positive potential and the negative potential, only a part of the ions which reaches the entrance of the ion trap mass spectrometer 13 can be introduced into the ion trap space. A range of the phase in which the ions are properly introduced into the ion trap space as described above is several percent of the total phases, and a large number of ions are is not provided to the analysis and discarded.

Also, a trapping potential of the ion trap is inversely proportional to the mass number of the ions. In order to increase the trap efficiency of the ions, kinetic energy of the ions is required to be substantially the same as the confinement potential. However, even if such a relationship is made in the specific ion, a potential necessary for confining or trapping is high for the ions having a lower mass number than that of the specific ion described above, and on the contrary, a potential necessary for confinement or trapping is low for the ions having a higher mass number than that of the specific ion, resulting in that the trap efficiency is decreased in both cases. Namely, the trap efficiency of the ion trap has a large mass dependency.

Accordingly, an object of the invention is to provide an ion trap mass spectrometer, which can carry out a measurement with much higher sensitivity by introducing much more ions into the ion trap space, to thereby solve the aforementioned problems.

Further objects and advantages of the invention will be apparent from the following description of the invention.

SUMMARY OF THE INVENTION

To achieve the aforementioned object, the present invention provides an ion trap mass spectrometer, which comprises an ion supply source; an ion trap; an ion storing section which is disposed between the ion supply source and the ion trap and accumulates the ions at an exit side by a radio-frequency electric field with an axial electric potential inclined from an entrance side to the exit side of the ion storing section; an entrance gate electrode disposed between the ion supply source and the ion storing section; and an exit gate electrode disposed between the ion storing section and the ion trap.

The ion trap mass spectrometer may include a control section for controlling the entrance gate electrode, the exit gate electrode, the ion trap, and the ion storing section. According to the control by the control section, the entrance gate electrode is opened while the exit gate electrode is closed to introduce the ions into the ion storing section. After a first predetermined period of time, the entrance gate electrode is closed to accumulate the ions near the exit side of the ion storing section. After a second predetermined period of time, the exit gate electrode is opened to thereby emit a bunch of ions. A bunch of ions is introduced into the ion trap with the ring electrode voltage being cut off. When the maximum amount of ions stays inside the ion trap, the ring electrode voltage is suddenly applied. Thus, the ions can be trapped efficiently.

BRIEF DESCRIPTION OF THE DRAWINGS

FIG. 5(*a*) is a circuit diagram showing a structural example of an ion storing section formed of multipole electrodes, in which an entire length of each pole electrode is formed of a resistor;

FIG. 5(*b*) is a graph showing a distribution of axial electric potential in the entire length of the pole electrode in FIG. 5(*a*);

FIG. 6(*a*) is a schematic structural view showing an ion storing section formed of multipole electrodes, in which only an exit side end portion of each pole electrode is formed of a resistor;

FIG. 6(*b*) is a graph showing a distribution of axial electric potential in the entire length of the pole electrode in FIG. 6(*a*);

FIG. 7(*b*) is a graph showing a distribution of axial electric potential in the entire length of each pole electrode in FIG. 7(*a*);

FIG. 8(*b*) is a graph showing a distribution of axial electric potential in the entire length of each pole electrode in FIG. 8(*a*);

DETAILED DESCRIPTION OF PREFERRED EMBODIMENTS

Figure 1:
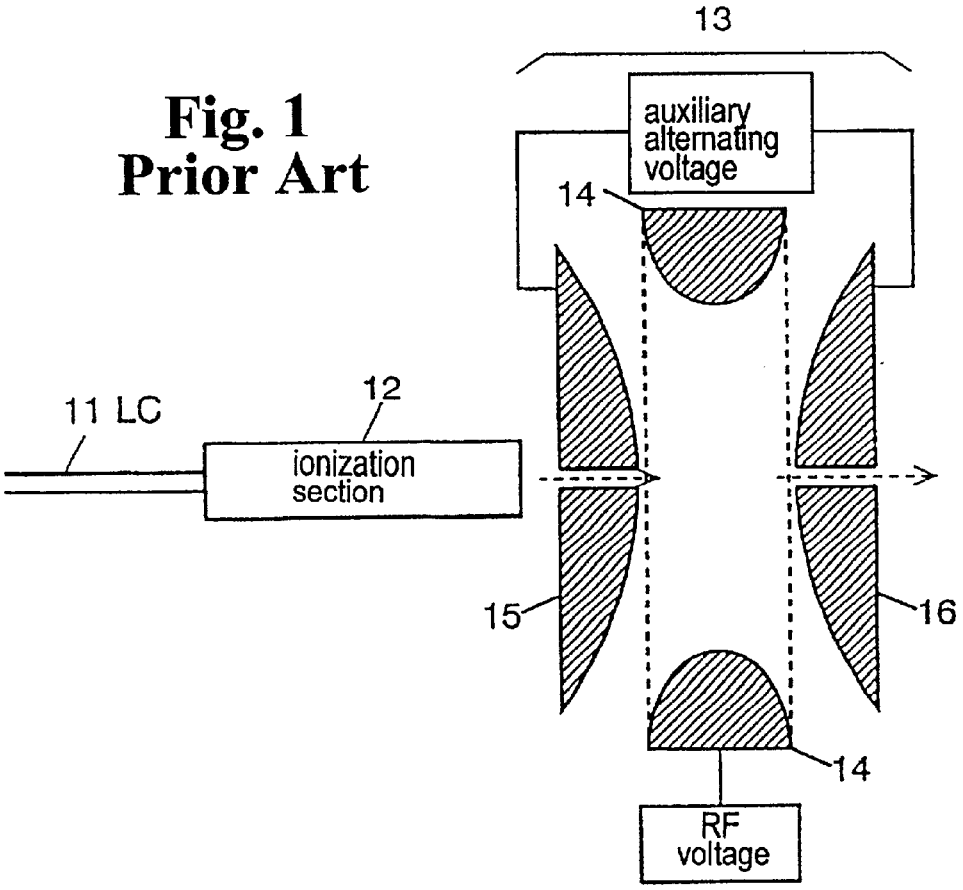
Fig. 1 Prior Art
FIG. 1 is a schematic structural view of an LCMS using a conventional ion trap mass spectrometer.
Figure 2:
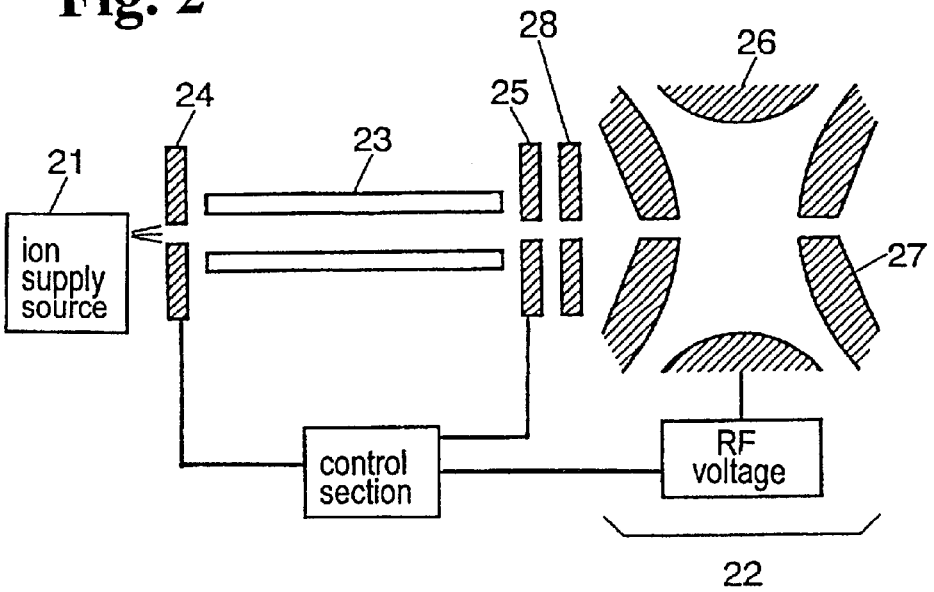
FIG. 2 is a schematic structural view of an ion trap mass spectrometer of an embodiment of the invention.

Hereunder, embodiments of the invention will be explained with reference to the accompanied drawings. An entrance gate electrode 24 allows ions supplied from an ion supply source 21 to pass therethrough for a predetermined period of time, such that the ions are allowed to flow into an ion storing section 23. Also, the entrance gate electrode 24 prevents the ions from entering into the ion storing sections 23 thereafter, and prevents the ions inside the ion storing section 23 from flowing outside from the entrance. For example, in case of the positive ions, at the time of introducing the ions, a voltage at the entrance gate electrode 24 is set to be slightly higher than the entrance DC voltage of the ion storing section 23. Then, during a period when the introduction of the ions is prevented (period of closing the entrance gate), the voltage at the entrance gate electrode 24 is set to be several tens voltage higher than the entrance DC voltage of the ion storing section 23. Accordingly, the introduction of the ions is prevented, and also, when the ions inside the ion storing section 23 approach the entrance side, the ions are reflected as described later.

Time for introducing the ions into the ion storing section 23 (opening time of the entrance gate electrode 24) is determined based on an amount of ions which can be introduced into an ion trap 22. Also, this opening time can be changed in accordance with the amount of the introduced ions. For example, a total amount of the ions provided for the measurement is obtained from a total ion amount measured by a mass spectrometer (ion trap 22 or a mass spectrometer in a subsequent step) in the steps of preceding tests, and based on this total amount, opening time of the entrance gate electrode 24 is determined in the present test so as not to saturate the ion trap 22.

Figure 3A:
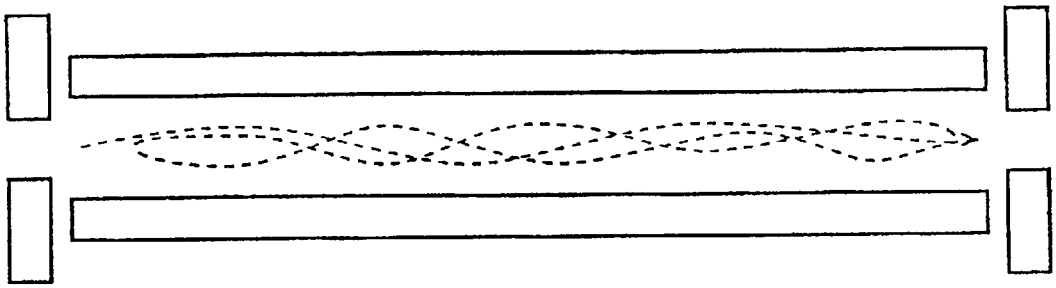
FIGS. 3(*a*) and 3(*b*) are explanatory views showing movements of ions in an ion storing section, wherein FIG. 3(*a*) is a view in case an inclined electric potential is not formed, and FIG. 3(*b*) is a view in case the inclined electric potential is formed.
Figure 3B:
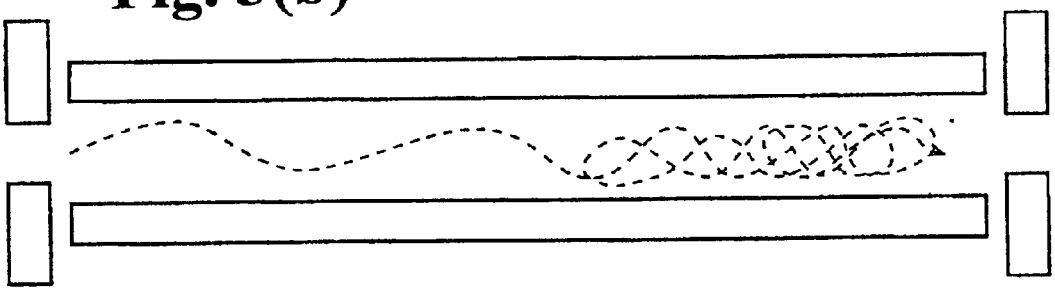

The ions entered into the ion storing section 23 are accumulated inside the ion storing section 23 by the RF electric field, and at the same time, the ions move inside the ion storing section 23 by initial kinetic energy. When the ions reach an exit gate electrode 25 or entrance gate electrode 24 at the end portions of the ion storing section 23, the ions are reflected by the voltage applied thereto, so that the ions are pushed back to the inside of the ion storing section 23 as shown in FIG. 3(*a*). The ions collide with a cooling gas while going back and forth inside the ion storing section 23 as described above, so that the ions gradually lose the kinetic energy. At the same time, by the axial electric field, which is formed in the ion storing section 23 and inclined from the entrance side toward the exit side, the ions are accumulated near the end portion of the exit side as shown in FIG. 3(*b*).

Figure 4:
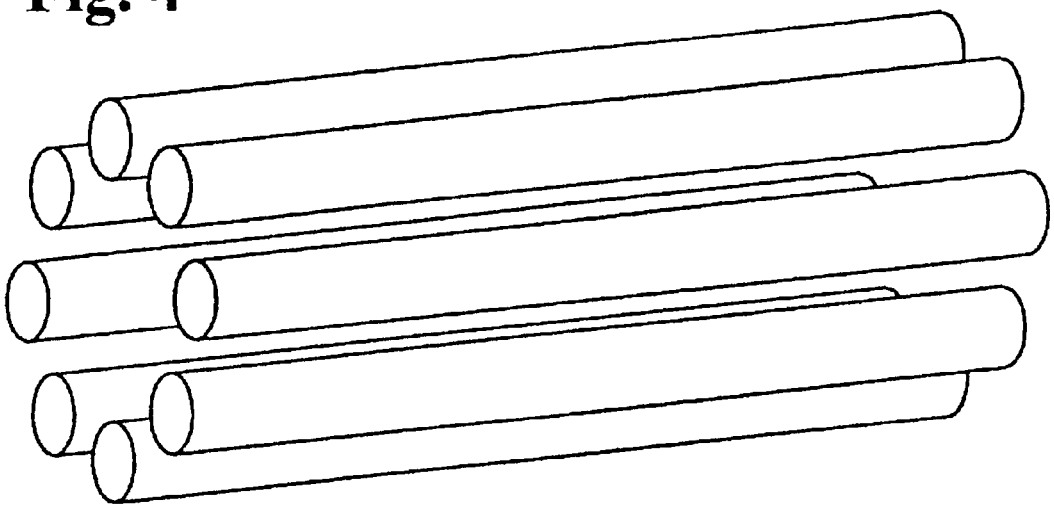
FIG. 4 is a perspective view of multipole electrodes.

The ion storing section 23 having the aforementioned characteristics can be achieved by various embodiments. As a first example, there can be exemplified an ion storing section using multipole electrodes. In the multipole electrodes, an even number of rod-like electrodes (pole electrode) are arranged parallel to each other and axially symmetrically, and RF voltage is applied to the respective pole electrodes while a phase difference between the pole electrodes adjacent to each other is set to be constant, so that a multipole RF electric field is formed inside the multipole electrodes, to thereby confine the ions having a predetermined mass number (mass/charge) therein. Although FIG. 4 shows octapole electrodes, the multipole electrodes may be quadrupole electrodes, or hexapole electrodes.

In case the multipole electrodes are used, a method of forming the axial electric potential inclined from the entrance side to the exit side can be achieved by various embodiments. FIGS. 5(*a*) and 5(*b*) show an embodiment in which respective pole electrodes are formed of resistors. As shown in FIG. 5(*a*), an RF voltage $V_{RF}$ is applied to each pole electrode, and DC voltages $V_{DC1}$ and $V_{DC2}$ having different values are respectively applied to both ends of the electrodes. Accordingly, as shown in FIG. 5(*b*), an axial electric potential inclined from the entrance side end portion to the exit side end portion of the ion storing section 23 is formed. Incidentally, it is needless to say that a direction of the inclination differs depending on the polarity (positive or negative) of the ions to be stored.

In view of the object, that is, "to accumulate the ions at the exit side end portion", it is not necessary to incline the axial electric potential throughout the entire length thereof from the entrance side end portion of the ion storing section 23 to the exit side end portion thereof, and the inclined electric field can exist only at the exit side end portion as shown in FIG. 6(*a*). In the example shown in FIG. 6(*a*), only a part of an exit side of the pole electrode is formed of a resistor, and an entrance side thereof is formed of a conductor. Accordingly, an axial electric potential becomes as shown in FIG. 6(*b*), and by this example, it is possible to achieve the object, that is, "to accumulate the ions at the exit side end portion".

Figure 7A:
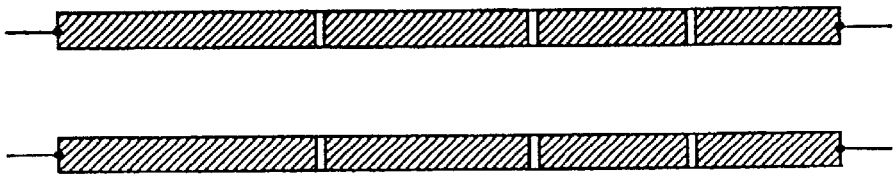
FIG. 7(*a*) is a schematic structural view showing an ion storing section formed of multipole electrodes, in which each pole electrode is divided into plural sections in a longitudinal direction and resistors having different resistivity are used in the respective divided sections.
Figure 7B:
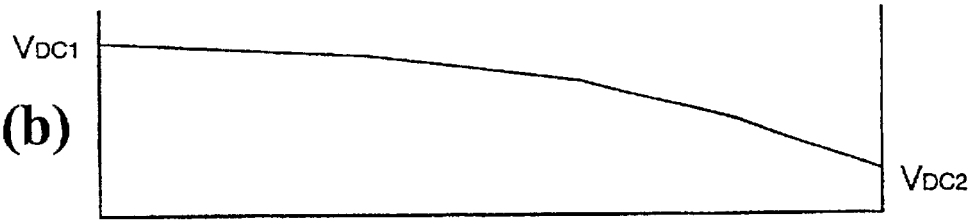

FIG. 7(*a*) shows an example that each pole electrode is divided in a longitudinal direction, in which respective divided portions are formed of resistors having different resistivity. Accordingly, the axial electric potential becomes as shown in FIG. 7(*b*). By adequately setting the resistivities of the respective resistors, the inclination form of the axial electric potential can be freely changed, so that a mode of the ion accumulation can be controlled.

Incidentally, in any of the aforementioned cases, the pole electrode including an inside (core) can be formed of the resistor, or only a surface of the pole electrode can be formed of the resistor.

Figure 8A:
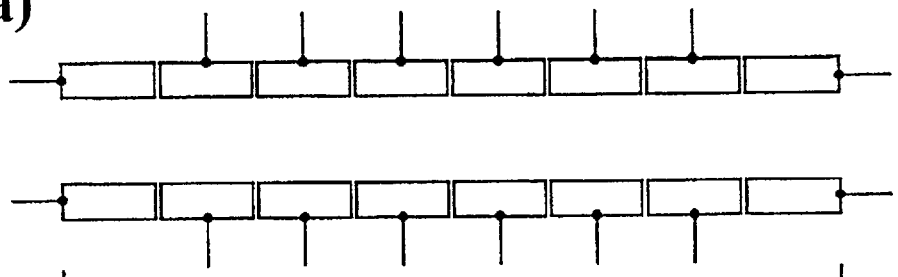
FIG. 8(*a*) is a schematic structural view showing an ion storing section formed of multipole electrodes, in which each pole electrode is longitudinally divided into plural sections formed of conductors to which different DC voltages are applied.
Figure 8B:
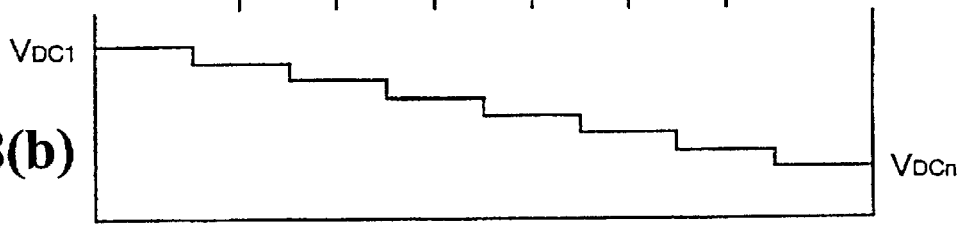

As shown in FIG. 8(*a*), each pole electrode can be formed of a plurality of conductor rods divided in the longitudinal direction. In this case, by applying DC voltages, which are different stepwisely, to the respective conductor rods, the electric field as shown in FIG. 8(*b*) can be formed.

Figure 9:
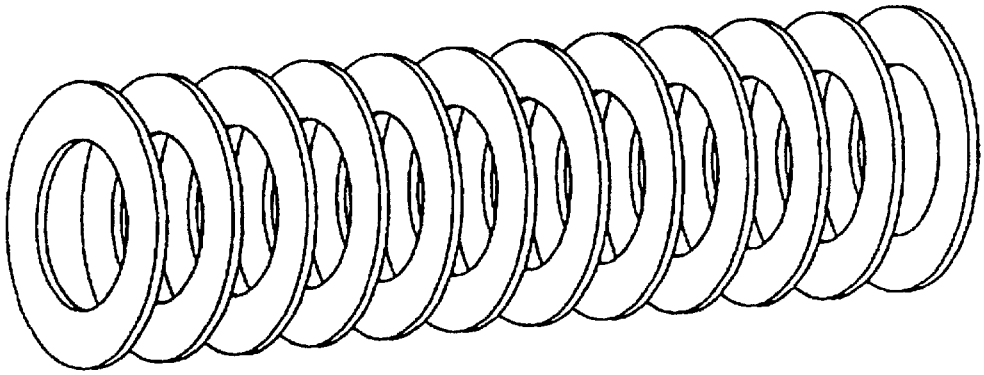
FIG. 9 is a perspective view of an ion storing section formed of a plurality of ring-like electrodes.

Also, the ion storing section 23 can be formed by the structure other than the multipole electrodes. FIG. 9 shows a structure in which a number of ring-like electrodes are arranged in an axial direction, and in this structure, DC voltages, which are different stepwisely, are applied to the respective ring-like electrode as in FIG. 8(*a*). Also, the RF voltages with the same frequency are applied to the respective ring-like electrodes at different phases. Accordingly, the introduced ions are stored in the ion storing section 23 as shown in FIG. 3(*b*), and the ions can be accumulated at the exit side end portion.

While the ions are held in the ion storing section 23, by adequately changing various parameters of the voltage applied to the ion storing section 23, for example, a magnitude of the RF voltage, a frequency, a magnitude of the DC voltage, the inclination mode and the like, the ions having a mass number other than the specific mass number can be excluded from the ion storing section, or only the ions within the specific mass number can be held at the ion storing section. The modification is available in the ion storing section 23 having any of the aforementioned structures.

Also, since an initial potential energy of the ions introduced into the ion trap 22 corresponds to a potential at a portion (an exit side end portion) of the ion storing section 23, where the ions are accumulated, by changing the potential at this portion, it is possible to change the kinetic energy of the ions at the time of introducing the ions into the ion trap 22.

As a cooling gas, inert gas, which is not ionized or split even if the gas collides with the ions, for example, nitrogen ($N_2$), helium (He), argon (Ar) or the like is used. The ion supply source 21 constitutes the ionization device in the liquid chromatograph, and in case a gas (nebulizer gas) used for ionization enters together with the ions into the ion storing section 23, it is not necessary to prepare a cooling gas source separately. However, in other cases (for example, in case of the gas chromatograph), there is provided a device for filling the ion storing section 23 with a cooling gas under a predetermined pressure.

While the ion storing section 23 is accumulating the ions at the exit side end portion thereof, the exit gate electrode 25 prevents the ions from escaping to the outside. By changing the potential of the exit gate electrode 25, the accumulated ions are bunched and introduced into the ion trap 22. At this time, furthermore, when the ions are ejected out of the exit gate electrode 25, the voltage at the exit gate electrode 25 is changed to push the ejected ions from behind, so that a pulse width of the ion can be compressed.

At this point, by placing the ion trap 22 in the state such that the ion trap does not repel the ions and is liable to receive the ions, the accumulated ions are introduced into the ion trap space without being wasted, so that the analysis with the high sensitivity can be carried out. The state that the ion trap 22 is likely to receive the ions can be achieved by, for example, not applying the RF voltage to a ring electrode 26 of the ion trap 22. Then, when all (or the largest amount) of the ions from the ion storing section 23 are introduced into the ion trap space, by instantaneously applying the RF voltage of the ring electrode 26, the ions are trapped in the ion trap space. Thereafter, the mass spectrometry is carried out in the same operations as in the conventional ion trap mass spectrometer. Of course, an MS—MS ($MS_n$ in general) analysis can be carried out.

Figure 10:
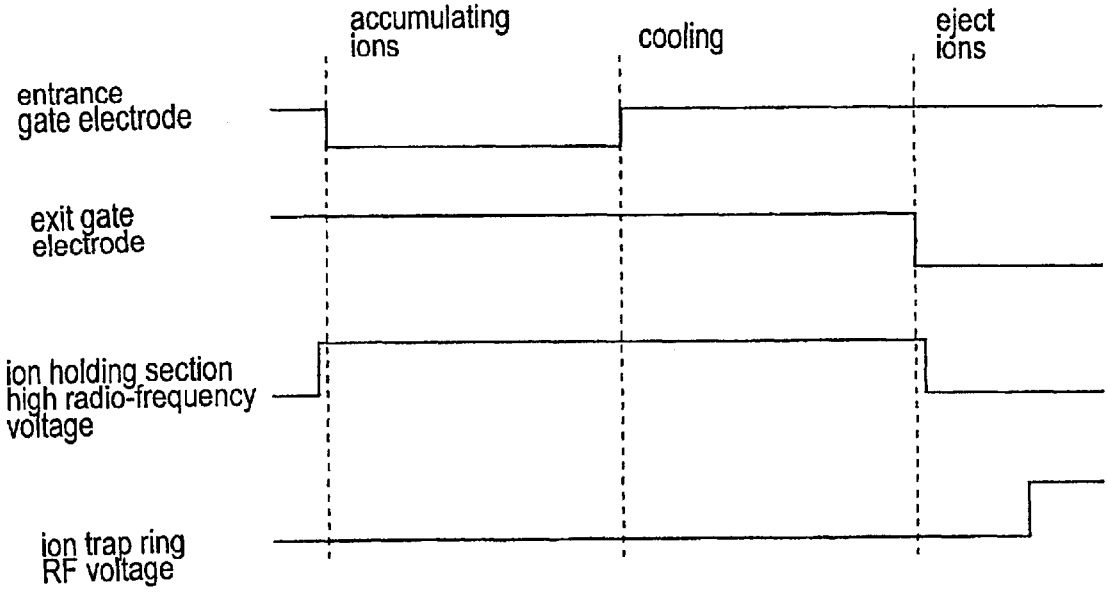
FIG. 10 is a sequence diagram showing a timing of applying voltages to the respective sections.

FIG. 10 shows a sequence of application timings of the entrance gate electrode 24, the exit gate electrode 25, the RF voltage of the ion storing section 23, and the RF voltage of the ring electrode 26 at the ion trap 22, which are controlled by control means.

In this sequence, before the entrance gate electrode 24 is opened (and after the exit gate electrode 25 is opened), the RF voltage of the ion storing section 23 is turned off in order to eject the ions, which remain in the ion storing section 23 in the respective repetitive steps, before the ions are introduced from the ion supply source 21.

Instead of turning off the RF voltage of the ring electrode 26 at the time of introducing the ions into the ion trap 22 as in the sequence shown in FIG. 10, it is possible to adopt a method of adjusting a timing such that a phase of the RF voltage of the ring electrode becomes a phase which is liable to introduce the ions.

When the ions are introduced into the ion trap 22, by applying the voltage with the same polarity as that of the ion (in case of the positive ion, the positive voltage is applied, and in case of the negative ion, the negative voltage is applied) to an end cap electrode 27 at the exit side (this voltage is called a retarding voltage), while being reflected by the retarding voltage, it is possible to prolong the time for introducing the ions.

An ion lens 28 for focusing the ions may be provided between the exit gate electrode 25 and the ion trap 22. A potential of the ion lens 28 may be changed temporally in synchronizing with the ejection of the ions from the ion storing section 23. Accordingly, the pulse width of the ion introduced into the ion trap 22 can be further shortened.

In the ion trap mass spectrometer according to the present invention, before the ions are introduced into the ion trap, the ions are once accumulated near the exit side end portion of the ion storing section, and thereafter, the ions in the pulse state are introduced into the ion trap. Therefore, an amount of ions, which are not introduced into the ion trap to thereby be wasted, can be made minimum. Also, since the ions are introduced in the pulse state, a tendency to the mass dependency of the ions which can be held in the ion trap space can be suppressed, and ions of the wide range of m/z can be held in the ion trap.

While the invention has been explained with reference to the specific embodiments of the invention, the explanation is illustrative and the invention is limited only by the appended claims.

What is claimed is:

1. An ion trap mass spectrometer, comprising:

an ion supply source for supplying ions, an ion storing section disposed near the ion supply source and having an entrance side close to the ion supply source, an exit side opposite to the entrance side, and means for providing an RF electric field for holding the ions inside ion storing section and an axial electric potential inclined from the entrance side to the exit side of the ion storing section so that the ions are confined and gathered near the exit side in the ion storing section, an entrance gate electrode disposed between the ion supply source and the entrance side of the ion storing section, said entrance gate electrode being controlled to introduce and retain the ions in the ion storing section, an exit gate electrode disposed near the exit side of the ion storing section, said exit gate electrode being controlled to retain the ions in the storing section and emitting a bunch of ions, an ion trap section disposed at a side opposite to the ion storing section relative to the exit gate electrode and comprising means for cutting off an RF voltage while the bunch of ions emitted from the ion storing section enters the ion trap section, and means for suddenly applying the RF voltage when a maximum amount of the ions stays inside the ion trap section, and control means connected to the entrance gate electrode, the exit gate electrode, the ion trap section, and the ion storing section for controlling the same, said control means controlling the entrance gate electrode and the exit gate electrode so that the entrance gate electrode is opened and the exit gate electrode is closed to introduce the ions into the ion storing section; after a first predetermined period of time, the entrance gate electrode is closed while the exit gate electrode is closed to accumulate the ions at the exit side of the ion storing section; after a second predetermined period of time, the exit gate electrode is opened to introduce the accumulated ions into the ion trap section at once.

2. An ion trap mass spectrometer according to claim 1, wherein said ion storing section is formed of multipole electrodes as the means for providing the radio-frequency electric field, at least one part of the multipole electrodes being formed of a resistor for providing the axial electric potential.

3. An ion trap mass spectrometer according to claim 1, wherein said ion storing section is formed of multipole electrodes as the means for providing the radio-frequency electric field, each electrode having plural sections divided in a longitudinal direction such that DC voltages are independently applied to the divided plural sections for providing the axial electric potential.

4. An ion trap mass spectrometer according to claim 1, wherein said ion storing section is formed of an assembly electrode as the means for providing the radio-frequency electric field, said assembly electrode including a plurality of annular electrodes arranged in an axial direction such that DC voltages and RP voltages are independently applied to the respective annular electrodes for providing the axial electric potential.

5. An ion trap mass spectrometer according to claim 1, further comprising an ion lens disposed between the exit gate electrode and the ion trap section.

6. An ion trap mass spectrometer according to claim 1, wherein said control means determines the first predetermined period of time as a time for opening the entrance gate electrode based on a total ion amount measured in one of preceding same steps.

7. An ion trap mass spectrometer according to claim 1, wherein said control means controls said means for providing the RF electric field to change at least one of parameters of the RF electric field and inclined electric potential so that ions other than desired ions are excluded from the ion storing section before the ions are introduced into the ion trap section.

8. An ion trap mass spectrometer according to claim 1, wherein said control means controls the means for providing the RF electric field to stop an application of the RF voltage to the ion storing section before introducing the ions therein so that the ions remaining in the ion storing section are removed.

9. An ion trap mass spectrometer according to claim 1, wherein a cooling gas is introduced into the ion storing section together with the ions.

* * * * *